US008512098B1

(12) United States Patent
Bonner

(10) Patent No.: US 8,512,098 B1
(45) Date of Patent: Aug. 20, 2013

(54) MACHINING TECHNIQUE USING A PLATED SUPERABRASIVE GRINDING WHEEL ON A SWISS STYLE SCREW MACHINE

(76) Inventor: Jeffrey Bonner, Naples, FL (US)

( * ) Notice: Subject to any disclaimer, the term of this patent is extended or adjusted under 35 U.S.C. 154(b) by 422 days.

(21) Appl. No.: 12/892,858

(22) Filed: Sep. 28, 2010

(51) Int. Cl.
*B24B 1/00* (2006.01)

(52) U.S. Cl.
USPC ..... 451/28; 451/48; 451/540; 451/541; 451/547

(58) Field of Classification Search
USPC ..... 451/28, 48, 57, 58, 71, 70, 403, 405, 451/540, 449, 488, 231, 242, 278, 283, 541, 451/542, 544, 547
See application file for complete search history.

(56) References Cited

U.S. PATENT DOCUMENTS

| | | | | | |
|---|---|---|---|---|---|
| 504,519 | A | * | 9/1893 | Budke | 451/426 |
| 688,437 | A | * | 12/1901 | Robinson | 82/165 |
| 1,271,495 | A | * | 7/1918 | Ward | 451/49 |
| 1,700,663 | A | * | 1/1929 | Bath | 451/48 |
| 2,144,987 | A | * | 1/1939 | Miller | 451/58 |
| 2,420,504 | A | * | 5/1947 | Stewart | 451/65 |
| 2,655,772 | A | * | 10/1953 | Lewis | 451/540 |
| 3,323,260 | A | * | 6/1967 | Oxford, Sr. | 451/48 |
| 3,553,908 | A | * | 1/1971 | Boehm | 451/405 |
| 3,610,075 | A | * | 10/1971 | Fabish | 76/108.6 |
| 3,626,644 | A | * | 12/1971 | Cupler, II | 451/48 |
| 3,680,263 | A | * | 8/1972 | Johnson | 451/23 |
| 3,754,357 | A | * | 8/1973 | Schnellmann et al. | 451/1 |
| 3,868,793 | A | * | 3/1975 | Corcoran et al. | 451/548 |
| 4,082,640 | A | * | 4/1978 | Haack | 204/279 |
| 4,263,754 | A | * | 4/1981 | DeTorre | 451/48 |
| 4,272,927 | A | * | 6/1981 | Myers et al. | 451/53 |
| 4,476,656 | A | * | 10/1984 | Bovenkerk | 451/56 |
| 4,548,000 | A | * | 10/1985 | Junker | 451/48 |
| 4,757,645 | A | * | 7/1988 | Ozer et al. | 451/541 |
| 4,827,675 | A | * | 5/1989 | Andrews | 451/28 |
| 5,129,188 | A | * | 7/1992 | Alverio | 451/48 |
| 5,471,900 | A | * | 12/1995 | Corwin et al. | 82/1.11 |
| 5,868,606 | A | * | 2/1999 | Martin | 451/48 |
| 5,888,129 | A | * | 3/1999 | Neff | 451/541 |
| 5,895,317 | A | * | 4/1999 | Timm | 451/548 |
| 6,129,077 | A | * | 10/2000 | Parini | 125/15 |
| 6,234,881 | B1 | * | 5/2001 | Martin, Jr. | 451/205 |
| 6,448,154 | B1 | * | 9/2002 | Guldi et al. | 438/462 |
| 6,585,558 | B1 | * | 7/2003 | Mori et al. | 451/5 |
| 6,692,343 | B2 | * | 2/2004 | Hirata et al. | 451/548 |
| 6,712,683 | B2 | * | 3/2004 | Brandstetter | 451/550 |
| 2003/0003853 | A1 | * | 1/2003 | Stocker | 451/57 |
| 2003/0008601 | A1 | * | 1/2003 | Toyama et al. | 451/49 |
| 2003/0186628 | A1 | * | 10/2003 | Brookins et al. | 451/57 |
| 2005/0202759 | A1 | * | 9/2005 | Dilger et al. | 451/48 |
| 2006/0246823 | A1 | * | 11/2006 | Morita et al. | 451/7 |
| 2009/0143000 | A1 | * | 6/2009 | Wimberly | 451/430 |
| 2009/0200748 | A1 | * | 8/2009 | Ochiai et al. | 277/415 |
| 2009/0239454 | A1 | * | 9/2009 | Yamashita et al. | 451/443 |

* cited by examiner

*Primary Examiner* — George Nguyen
(74) *Attorney, Agent, or Firm* — Allen D. Hertz, P.A.; Allen D. Hertz

(57) ABSTRACT

A material working process using a plated superabrasive grinding wheel having a superabrasive plating applied to a circumferential surface of a cylindrically shaped core. The plating is applied to at least a lower portion of a circumferential surface of the core continuing around a lower edge of the core and along a circumferential edge of a bottom surface of the core. The superabrasive grinding wheel is utilized by a Swiss style screw machine for abrading a raw bar stock. The grinding wheel is rotated abrading the raw bar stock as the stock is advanced along a longitudinal axis. The bar stock can be rotationally stationary to form a planar surface or rotating to form an arched surface. A machining lubricant is applied to the working interface for lubrication and cooling. The stationary work piece can be indexed to form repeated planar surfaces having various angles therebetween.

22 Claims, 10 Drawing Sheets

MACHINING TECHNIQUE USING A PLATED SUPERABRASIVE GRINDING WHEEL ON A SWISS STYLE SCREW MACHINE

FIELD OF THE INVENTION

The present disclosure generally relates to a grinding process. More particularly, the present disclosure relates to a grinding process using a superabrasive grinding wheel having a superabrasive material plated upon a grinding wheel core, the grinding process operationally completed using a Swiss Style Screw Machine.

BACKGROUND OF THE INVENTION

Conventional machining, one of the most important material removal methods, utilises any of a collection of material-working processes whereby power-driven machine tools, such as lathes, milling machines, and drill presses, use a sharp cutting tool to mechanically shear and remove slivers of the material to achieve the desired geometry. Machining is a part of the manufacturing process of almost all metal products. Machining is also commonly used for shaping other materials, such as wood and plastic. In current industry, it is common to adapt computer control technology to the machining process, whereby the process is referred to as computer numerical control (CNC) machining.

Originally, the term machining or "traditional" machining processes, referred to processes such as turning, boring, drilling, milling, broaching, sawing, shaping, planing, reaming, and tapping, or sometimes to grinding. With the advent of new technologies such as electrical discharge machining, electrochemical machining, electron beam machining, photochemical machining, and ultrasonic machining, the retronym "conventional machining" can be used to differentiate the classic technologies from the newer ones. The term "machining" without qualification usually implies conventional machining.

Turning operations are operations that rotate the work piece as the primary method of moving metal against the cutting tool. Lathes are the principal machine tool used in turning. The cutting tool is similar to a chisel, which removes fine slivers of material from an axially rotating work piece.

Milling operations are operations in which the cutting tool rotates to bring cutting edges to bear against the work piece. Milling machines are the principal machine tool used in milling. Milling cutters are cutting tools typically used in milling machines (and occasionally in other machine tools). They remove material by their movement within the machine (e.g., a ball nose mill) or directly from the cutter's shape (e.g., a form tool such as a hobbing cutter). Milling cutters are provided in a variety of form factors, each having one feature in common; the cutters shear slivers of materials away from the raw material.

Another important quality of the milling cutter to consider is its ability to deal with the swarf generated by the cutting process. If the swarf is not removed as fast as it is produced, the flutes will clog and prevent the tool cutting efficiently, causing vibration, tool wear and overheating. Several factors affect swarf removal, including the depth and angle of the flutes, the size and shape of the chips, the flow of coolant, and the surrounding material. It may be difficult to predict, but a good machinist will watch out for swarf build up, and adjust the milling conditions if it is observed.

The milling process relies on a solid piece of raw material to counter the forces generated from the cutting process. The accuracy of the milling process is significantly reduced when the rigidity of the raw material is reduced. An example would be an elongated rod, where the rod would chatter (vibrates) during the milling process.

A screw machine is a metalworking machine tool used in the high-volume manufacture of turned components. Screw machines are fundamentally a type of lathe that is specialized for the automated production of small parts. In today's industry, the majority of screw machines are fully automated, whether mechanically (via cams) or by CNC (computerized control), which means that once they are set up and started running, they continue running and producing parts with very little human intervention. By way of example: a bar of material is fed forward through the spindle. The face of the bar is machined (facing operation). The outside of the bar is machined to shape (turning operation). The bar is drilled or bored, and finally, the part is cut off (parting operation). Like the milling operation, the screw machine utilizes cutting tools.

What is desired is a machining process capable of accurately shaping an elongated rod or other thin, flexible material. The process would also be adaptable for machining more rigid stocks of material for flexibility.

SUMMARY OF THE INVENTION

The basic inventive concept utilizes a superabrasive media plated onto a core forming a superabrasive grinding wheel. The superabrasive grinding wheel is positioned into a tool holder or spindle collet chuck of a Swiss style screw machine. The raw stock is fed along an axial direction by the machine, passing across the rotating superabrasive grinding wheel.

A first aspect of the present invention provides a product fabrication method, the method comprising the steps:

obtaining a superabrasive grinding wheel, the superabrasive grinding wheel comprising:

- a cylindrically shaped core,
- a shank extending axially from a central location of the core,
- a superabrasive plating applied to at least a lower portion of a circumferential surface of the core continuing around a lower edge of the core and along a circumferential edge of a bottom surface of the core;
- mounting the shank of the superabrasive grinding wheel into a spindle collet chuck of a Swiss style screw machine;
- positioning a section of raw bar stock into a machining position in the Swiss style screw machine;
- positioning the superabrasive grinding wheel into position respective to the raw bar stock;
- rotating the superabrasive grinding wheel;
- supporting the raw bar stock using a bar stock guide bushing, wherein the guide bushing is located proximate the circumferential surface of the superabrasive grinding wheel;
- advancing the raw bar stock passing in contact with the rotating superabrasive grinding wheel; and
- removing material from the raw bar stock using an abrading process created by the contact between the rotating superabrasive grinding wheel against the raw bar stock.

A second aspect of the present invention includes a step of preparing the Swiss style screw machine by uploading a program into an operation memory.

In another aspect, the process further comprises a step of applying a machining lubricant to the superabrasive grinding wheel and raw bar stock interface.

In another aspect, the process further comprises a step of rotating the raw bar stock during the abrading process.

In another aspect, the process further comprises a step of retracting the raw bar stock, indexing the raw bar stock and repeating the advancing the raw bar stock step.

In another aspect, the process further comprises a step of rotating the superabrasive grinding wheel in a first direction and rotating the raw bar stock in a second direction, where the two motions cause the superabrasive grinding wheel and the raw bar stock to move in opposite directs at a contact point.

In another aspect, the bar stock guide bushing is stationary and the raw bar stock is advance by a motion of a sliding head stock.

In another aspect, the process further comprises a step of vertically positioning the spindle collet chuck.

In another aspect, the process comprises a step of orienting the grinding wheel wherein the axis of rotation is perpendicular to a longitudinal axis of the bar stock.

In another aspect, the process comprises a step of orienting the grinding wheel wherein the axis of rotation is parallel to the longitudinal axis of the bar stock.

In another aspect, the process comprises a step of orienting the grinding wheel wherein the axis of rotation is at an acute angle respective to the longitudinal axis of the bar stock.

In another aspect, the bottom surface of the grinding wheel includes an undercut which creates a gap between the bottom surface of the grinding wheel and the work surface of the bar stock.

In another aspect, the machine rotates the bar stock during the step of removing material from the raw bar stock using the abrading process created by contact between the rotating superabrasive grinding wheel against the raw bar stock.

These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
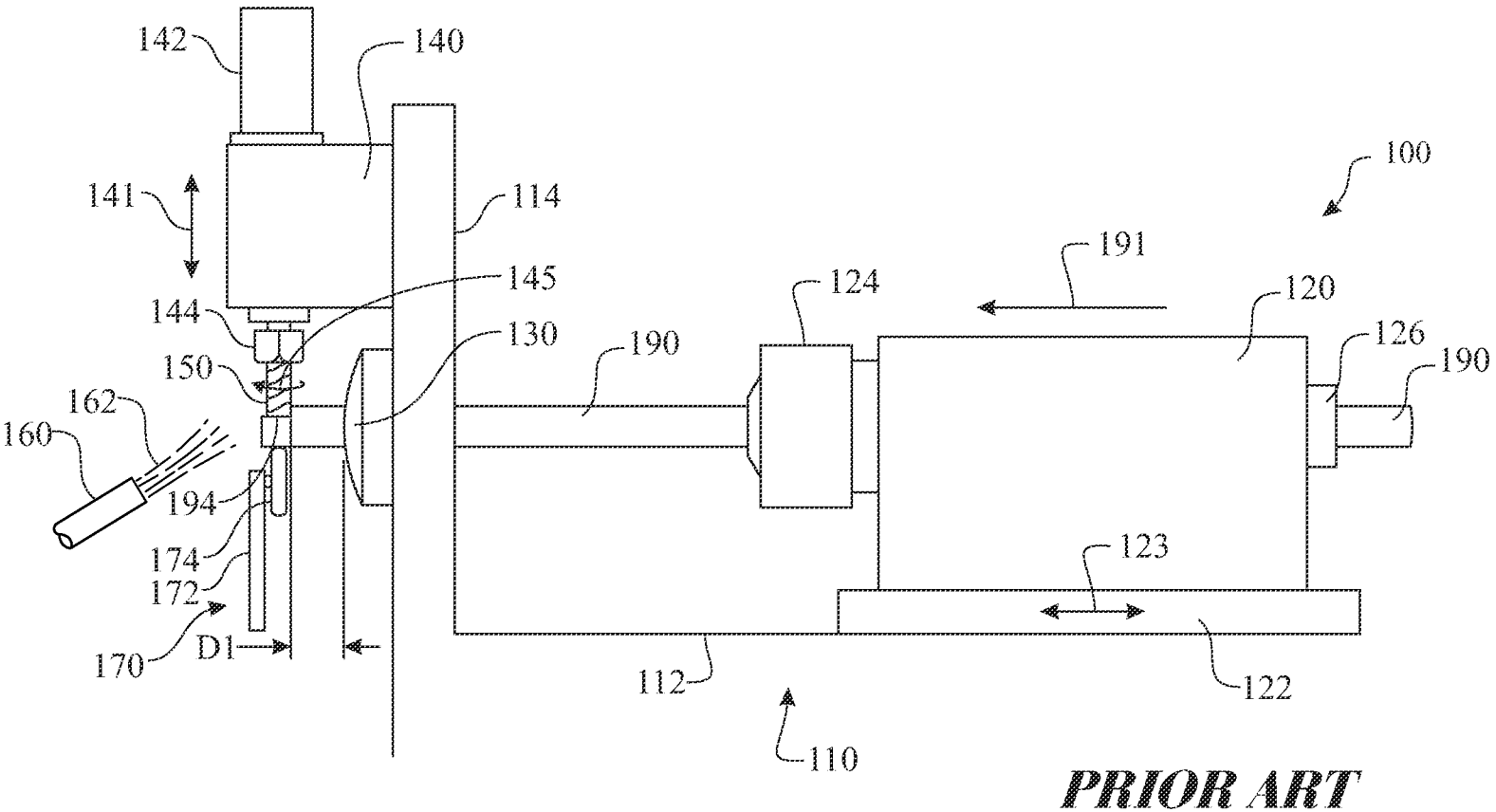
PRIOR ART FIG. 1
FIG. 1 presents a side elevation view of a common machining application using a Swiss style screw machine.

A Swiss style screw machine 100 is initially presented in FIG. 1 demonstrating the common application thereof. The Swiss style screw machine 100 is in its simplest form, a lathe machine. The Swiss style screw machine 100 includes a machine frame 110 providing support between the various components. The Swiss style screw machine 100 is segmented into two sections: a machining section and a stock advancing section. A sliding head stock 120 includes a sliding head stock base 122, which is slideably assembled to a machine horizontal sliding surface 112. A position controlling interface is provided between the head stock base motion 123 and the machine horizontal sliding surface 112. The position controlling interface would include an operational mechanism that is preferably computer controlled to horizontally position the head stock base motion 123 respective to a bar stock guide bushing 130. The bar stock guide bushing 130 is fastened to a machine vertical sliding member 114 of the machine frame 110 to support a working end of the bar stock 190. The bar stock guide bushing 130 can be a dead support (stationary) or a live support (rotates in conjunction with the bar stock 190). The operational mechanism would be any of many controllers that are readily available. The sliding head stock 120 moves in accordance to a head stock base motion 123. A bar stock clamping drive collet 124 and a bar stock rear guide 126 are assembled to a forward end and a rear end respectively of the sliding head stock 120 for controlling a rotational and axial position of a bar stock 190. The bar stock 190 is normally secured within the bar stock clamping drive collet 124. The bar stock rear guide 126 provides additional support to a trailing end of the bar stock 190.

A vertical slide member 140 is slideably attached to the machine vertical sliding member 114 of the machine frame 110. A position controlling interface is provided between the vertical slide member 140 and the machine vertical sliding member 114. The position controlling interface would include an operational mechanism that is preferably computer controlled to vertically position the vertical slide member 140 respective to the bar stock 190 in accordance with a vertical slide member motion 141. The operational mechanism would be any of many controllers that are readily available. A tool spindle drive motor 142 is integrated into the vertical slide member 140 to rotationally drive a spindle collet chuck 144. A cutting tool 150 is secured within the spindle collet chuck 144 and positioned against a working end of the bar stock 190 to modify the shape of the bar stock 190. The cutting tool 150 is fabricated having a small diameter to meet the required tool cutting speed. The arrangement dictates a span dimension D1 between a supporting edge of the bar stock guide bushing 130 and a leading cutting edge of the cutting tool 150. The span dimension D1 cantilevers the working end of the bar stock 190 requiring a work piece support system 170. The work piece support system 170 positions a stock support rest 174 against a side of the bar stock 190 opposite the cutting tool 150. A stock support column 172 supports the stock support rest 174. The stock support rest 174 can be rigidly or rotationally coupled to the stock support column 172. It is understood that any reasonable support member can be utilised for the work piece support system 170.

The cutting tool 150 rotates in accordance with a spindle collet chuck rotation 145, removing slivers of material from the working end of the bar stock 190. The bar stock 190 is advanced by the sliding head stock 120 in accordance with a bar stock feed motion 191. The bar stock 190 can remain in a fixed rotational orientation forming a planar bar stock machined feature 194 or rotated to form an arched bar stock machined feature (similar to the feature 532 of FIG. 9). A machining lubricant supply tube 160 is provided to discharge machining lubricant 162 towards a working interface between the cutting tool 150 and the bar stock 190. The machining lubricant 162 lubricates and cools the cutting surface and work piece. The current cutting process can cause the working end of the bar stock 190 to flex or chatter as a result of certain conditions. The flexing or chattering can occur in a bar stock 190 having a small cross sectional area and/or where the span dimension D1 is extended causing imperfections in the work section.

Figure 2:
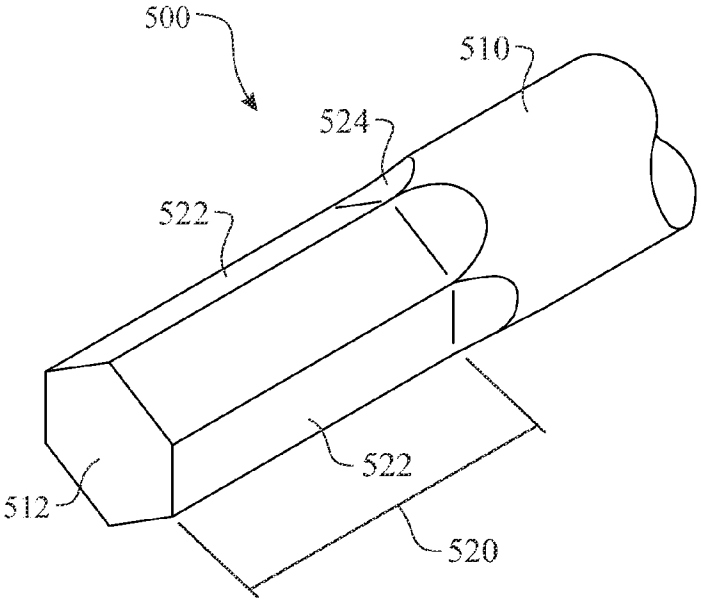
FIG. 2 presents an isometric view of an exemplary product shaped using the inventive process.

An exemplary desired product is illustrated in FIG. 2. The exemplary desired product includes a machined feature portion 520 formed upon a bar stock work end 512 of a bar stock 500. The machined feature portion 520 is fabricated having a series of planar machined surface 522 positioned in an indexed manner about a circumference of the raw bar stock portion 510. A machined surface transition 524 is formed between the raw bar stock portion 510 and the planar machined surface 522. The machined surface transition 524 is shaped respective to the selected machining tool and/or the programmed machining process. It is understood that the raw bar stock portion 510 can additionally include machining to form a central bore (not shown, but well understood).

Figure 3:
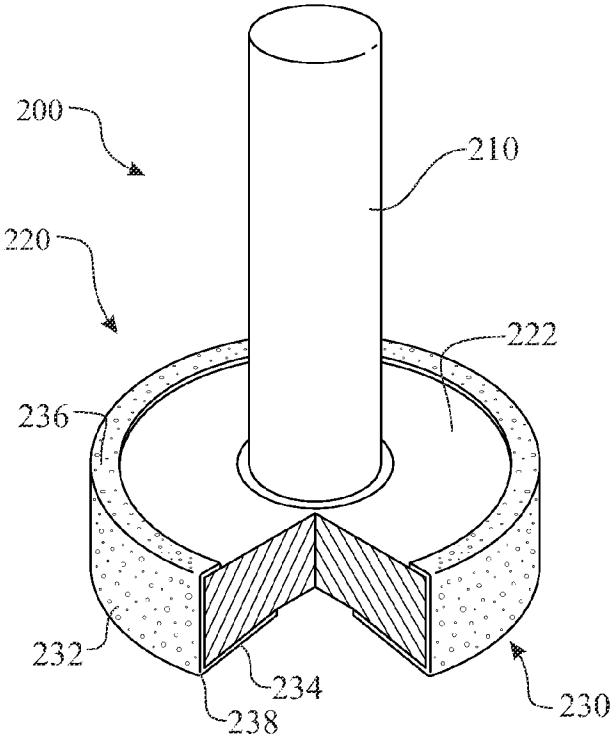
FIG. 3 presents an isometric view, including a cutaway section, of an exemplary plated superabrasive grinding wheel, the illustrated embodiment including an integral shank.
Figure 4:
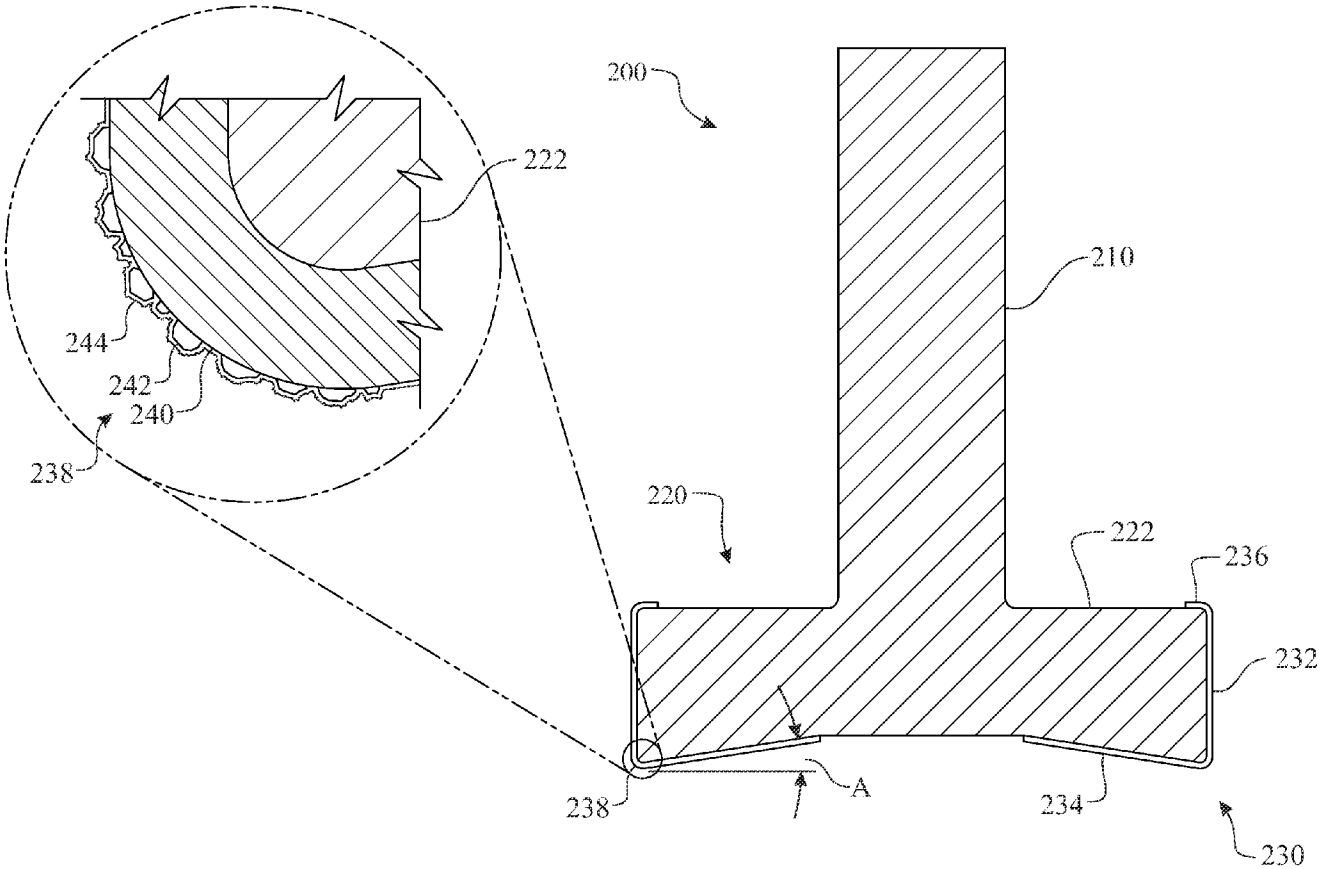
FIG. 4 presents a sectioned side elevation view of the plated superabrasive grinding wheel of FIG. 3, the section taken along a vertical center plane.

The inventive process utilises a plated superabrasive grinding wheel having integral shank 200 as detailed in FIGS. 3 and 4 as the shaping tool in conjunction with the Swiss style screw machine 100. The plated superabrasive grinding wheel having integral shank 200 includes a grinding wheel shank 210 integrated with a grinding wheel 220. The grinding wheel 220 is created by applying a plated superabrasive 230 to a surface of a grinding wheel core 222. A preferred plating process applies the plated superabrasive 230 to the grinding wheel core 222, creating a circumferential plated surface 232, continuing about a circumferential edge of a lower surface of the grinding wheel core 222 creating a lower plated surface 234, and continuing about circumferential edge of an upper surface of the grinding wheel core 222 creating a upper plated surface 236. The lower surface of the grinding wheel core 222 preferably includes a countersunk recession as presented by angle A illustrated in FIG. 4. The exemplary plated superabrasive 230 is applied to the grinding wheel core 222 by plating a layer of abrasive plating 240 onto the desired area of the grinding wheel core 222 as detailed in the magnified view of a plated corner 238 of the grinding wheel 220. Exterior abrasive grains 242 remain exposed creating an abrasive surface. A layer of nickel plating 244 can be applied over the exterior abrasive grains 242 to increase the grinding time longevity of the grit of the exterior abrasive grains 242. It is understood the plated superabrasive 230 can be limited to a working area of the grinding wheel core 222. This would include a lower portion of the circumferential plated surface 232, the respective lower edge of the grinding wheel core 222 and a narrow portion of the circumferential edge of the lower plated surface 234.

Figure 5:
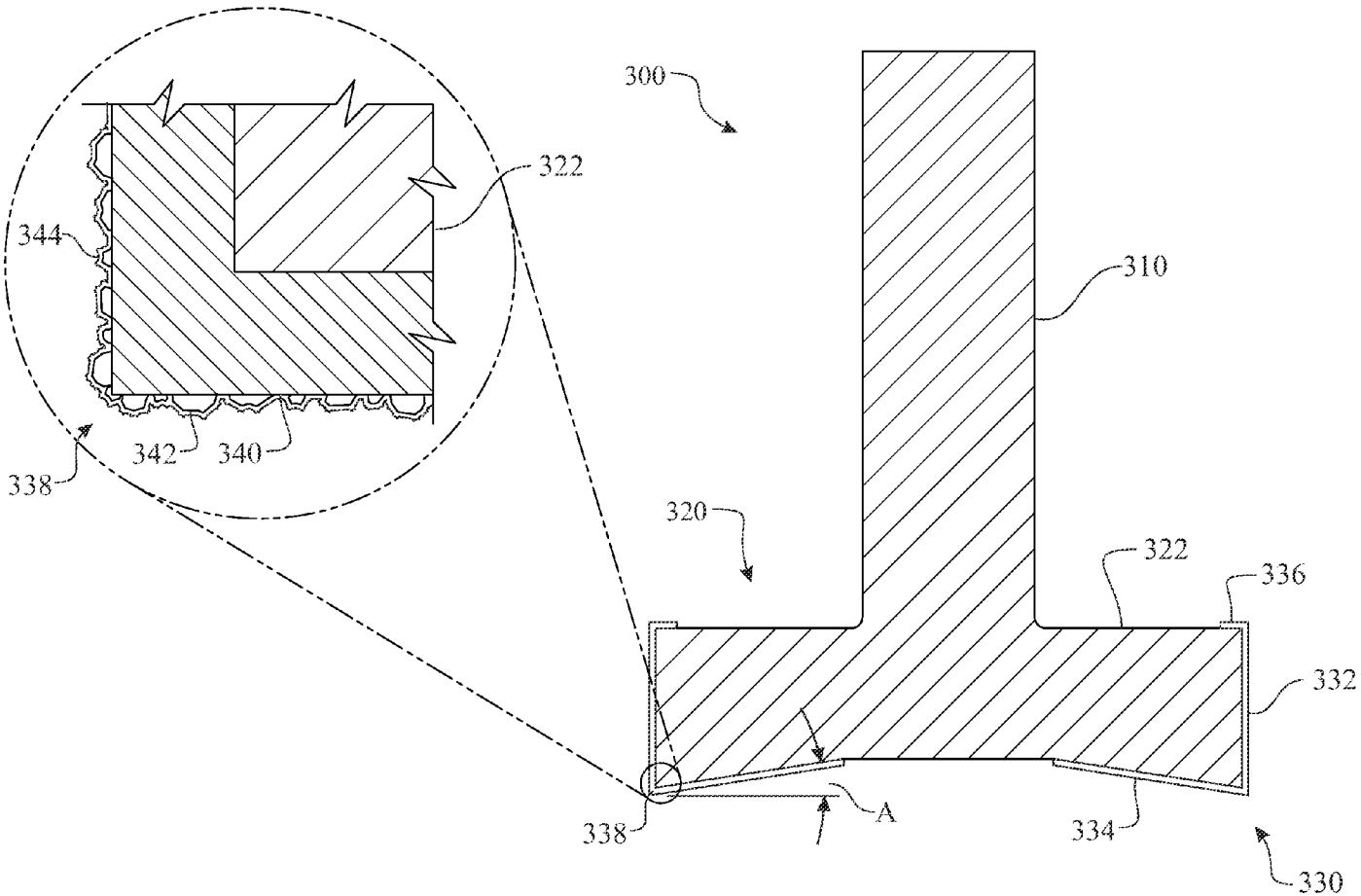
FIG. 5 presents a sectioned side elevation view of a second exemplary plated superabrasive grinding wheel having a squared corner edge, the section taken along a vertical center plane.

A second exemplary embodiment of the plated superabrasive grinding wheel is referenced as a plated superabrasive grinding wheel having integral shank 300 and illustrated in FIG. 5. Like features of plated superabrasive grinding wheel having integral shank 200 and plated superabrasive grinding wheel having integral shank 300 are numbered the same except preceded by the numeral '3'. The significant difference between the plated superabrasive grinding wheel having integral shank 200 and plated superabrasive grinding wheel having integral shank 300 is the shape of the corner. The plated superabrasive grinding wheel having integral shank 200 includes a radiused corner, whereas the plated superabrasive grinding wheel having integral shank 300 includes a crisp, squared off corner. The concern with the crisp, squared off corner is the longevity of the exterior abrasive grains 342 at the corner.

Figure 6:
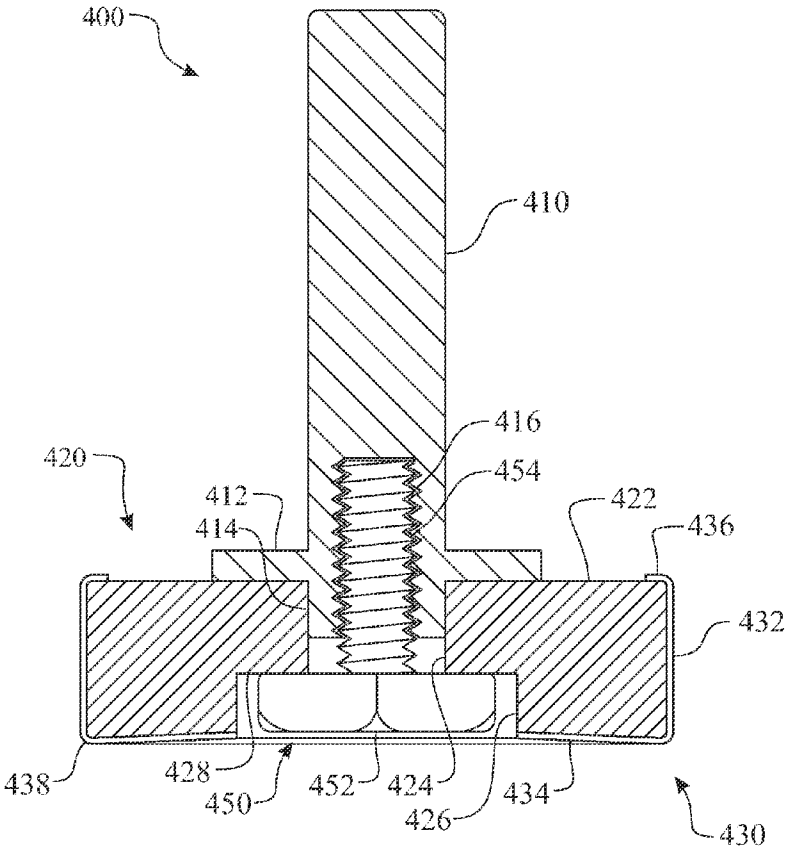
FIG. 6 presents a sectioned side elevation view of a third exemplary plated superabrasive grinding wheel, the illustrated embodiment including a removable arbor, the section taken along a vertical center plane.

A third exemplary embodiment of the plated superabrasive grinding wheel is referenced as a plated superabrasive grinding wheel assembly 400 and illustrated in FIG. 6. Like features of plated superabrasive grinding wheel having integral shank 200 and plated superabrasive grinding wheel assembly 400 are numbered the same except preceded by the numeral '4'. The plated superabrasive grinding wheel assembly 400 includes a grinding wheel arbor 410, which is removably joined to the grinding wheel 420. The grinding wheel arbor 410 is shaped having an arbor pilot 414 extending axially from an arbor mounting flange 412. A grinding wheel locating bore 424 is centrally located through the grinding wheel core 422 for tightly receiving the arbor pilot 414. The grinding wheel arbor 410 is secured to the grinding wheel 420 using a mechanical fastener, such as a threaded fastener 450. The threaded fastener 450 is inserted into a fastener receiving cavity 426 provided in a lower surface of the grinding wheel core 222. The threaded fastener 450 includes a fastener head 452 and a male threaded section 454. A female threading 416 is formed within a mating end of the grinding wheel arbor 410 along an axial direction. The threaded fastener 450 is placed through the grinding wheel locating bore 424, positioning the fastener head 452 against a cavity shoulder 428, and threaded into the female threading 416. A thread securing agent can be dispensed upon the male threaded section 454 prior to engagement with the female threading 416.

Figure 7:
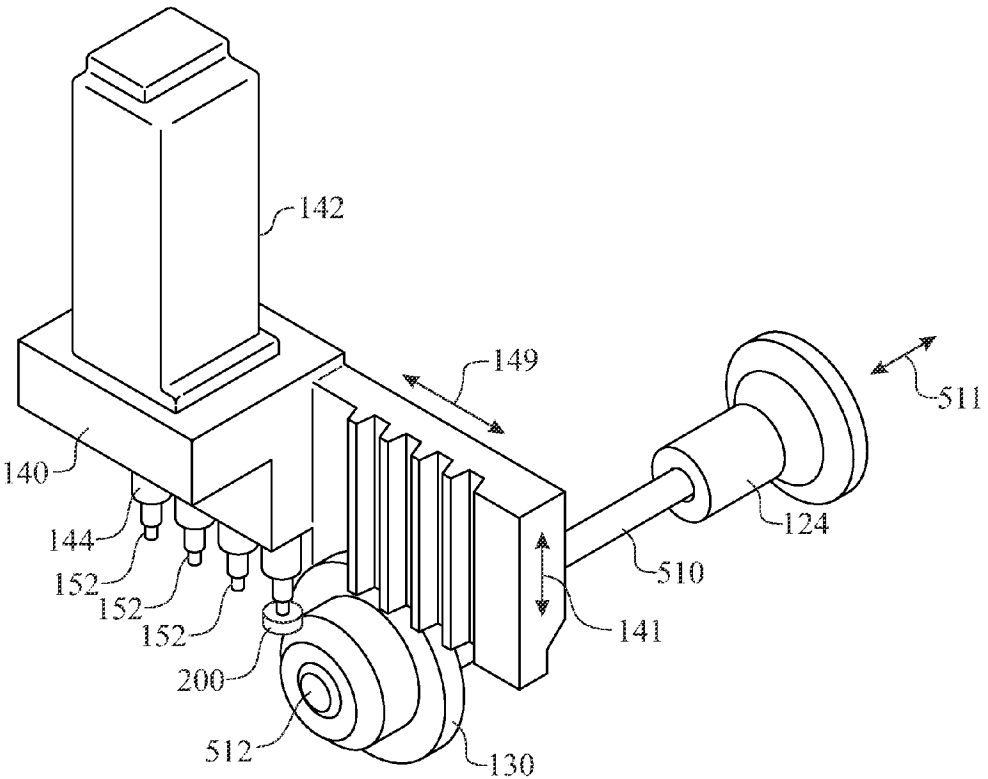
FIG. 7 presents an isometric view of an exemplary working section of the Swiss style screw machine.
Figure 8:
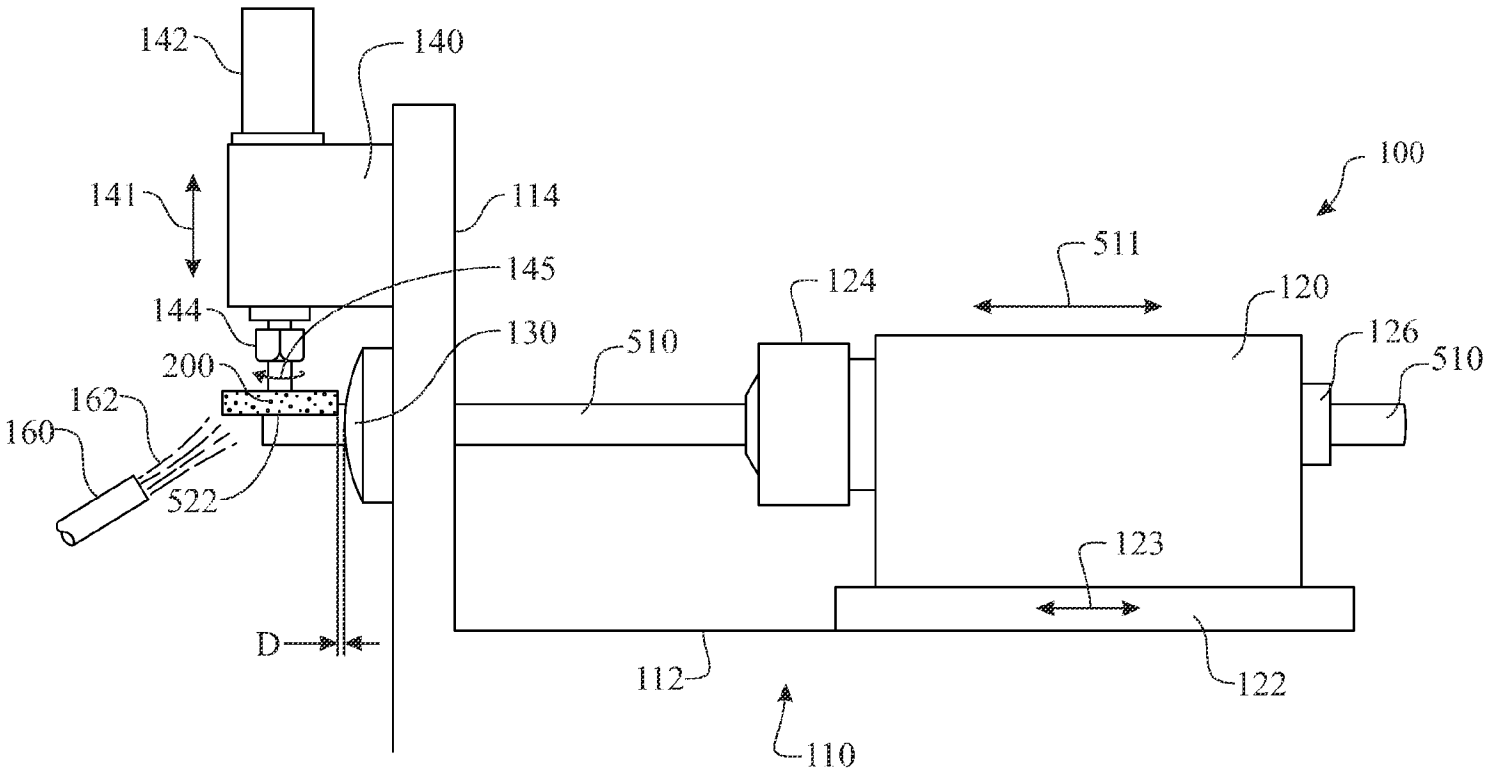
FIG. 8 presents a side elevation view of the Swiss style screw machine utilizing the plated superabrasive grinding wheel for fabricating a product in accordance with a first exemplary abrading process fabricating a ground planar surface onto the product.

Commencing with the operation of the present invention, a plated superabrasive grinding wheel 200 is installed for use into a Swiss style screw machine 100 as presented in the operational portion of the Swiss style screw machine 100 detailed illustration of FIG. 7. The vertical slide member 140 can include a plurality of spindle collet chucks 144 for maintaining a plurality of cutting tools 152 and the plated superabrasive grinding wheel 200. The superabrasive grinding wheel 200 is presented, being representative of any superabrasive grinding wheel 200, 300, 400. The vertical slide member 140 positions the desired tool, such as the plated superabrasive grinding wheel 200, into position for grinding a working end (essentially the machined feature portion 520 during processing) of the raw bar stock portion 510. The vertical slide member 140 can move in both a vertical slide member motion 141 and a tool drive lateral motion 149. The plated superabrasive grinding wheel 200 is positioned with the circumferential edge very close to the working edge of the bar stock guide bushing 130 as referenced by distance D in FIG. 8. It is noted that distance D is much smaller than distance D1 (FIG. 1). The bar stock clamping drive collet 124 advances the raw bar stock portion 510 through the bar stock guide bushing 130 in accordance with a bar stock motion 511, whereby the bar stock guide bushing 130 stabilizes the raw bar stock portion 510. The tool spindle drive motor 142 drives the selected spindle collet chuck 144, which rotates the plated superabrasive grinding wheel 200. The plated superabrasive grinding wheel 200 removes material from the working end of the raw bar stock portion 510 forming a planar machined surface 522 as illustrated in FIG. 8. The circumferential plated surface 232 (FIG. 3) provides the primary working surface of the plated superabrasive grinding wheel 200, abrading material from the raw bar stock portion 510 as the raw bar stock portion 510 advances. The countersunk bottom surface of the grinding wheel 220 separates the bottom surface from the work surface, thus reducing any friction, material build up, and a variety of other detrimental scenarios. One significant advantage of the present invention is that the plated superabrasive grinding wheel 200 captured by the driven tool spindle 145 of the Swiss style screw machine 100 can be operated at a higher speed that is significantly higher than the typically accepted speed of a milling or turning style cutter. This higher operating speed and finer particle removal rate of the small abrasive crystals significantly reduces chatter and improves the quality of accuracy and surface finish of the product. This speed is typically measured in surface feet per minute (SFPM) and is based upon two components, the revolutions per minute (RPM) and the allowable maximum diameter of the working tool. A Swiss style screw machine 100 operates at a limited maximum RPM and has a limited maximum allowable tool diameter; both of which are fixed parameters established by the machine tool manufacturer. Even with the RPM and the tool diameter operating at their maximum allowances on the Swiss style screw machine 100, the SFPM of the plated superabrasive grinding wheel 200 runs at a speed that is significantly lower than a previously accepted minimum speed for this type of abrasive crystal. It is for this reason that the plated superabrasive grinding wheel 200 would not be considered to be used in a Swiss style screw machine 100 and machinists are directed away from using any grinding wheels with the Swiss style screw machine 100. The present invention was reduced to practice and contrary to the general machinists beliefs and teachings, was found to be successful when used to fabricate very fine, precise products and deliver exceptional tool life.

Another significant advantage of the inventive process is the elimination of any burrs, which would normally need a post machining operation when fabricated using a milling or other cutting process.

Another advantage of the plated superabrasive grinding wheel 200 is that it maintains its shape until failure and does not require dressing or any other reshaping of the wheel. Bonded style grinding wheels (vetrified and resin bond being the most common form factors) exhibit significant wheel wear during use and require frequent dressing to maintain the original wheel shape. The abrasive particles from the bonding style wheel dressing and operation modes embed the particulate matter into the bearings of the machine, coolant, and other operational features impacting the functionality and maintenance of the Swiss style screw machine 100. Contrarily, the plated superabrasive grinding wheel 200 has very little loss of abrasive particles over the life of the wheel, thus virtually eliminating these contamination issues.

The exemplary embodiment presented in FIG. 8 illustrates a fabrication process that creates a planar machined surface 522. The raw bar stock portion 510 advances until the abrasion is completed along a desired length. The raw bar stock portion 510 is then retracted, rotated in accordance with a desired rotational index, and then the process is repeated. In the exemplary embodiment presented in FIG. 2, the raw bar stock portion 510 would be rotated a total of six positions. Machining lubricant 162 is applied to the working interface during any of the exemplary grinding processes.

Figure 9:
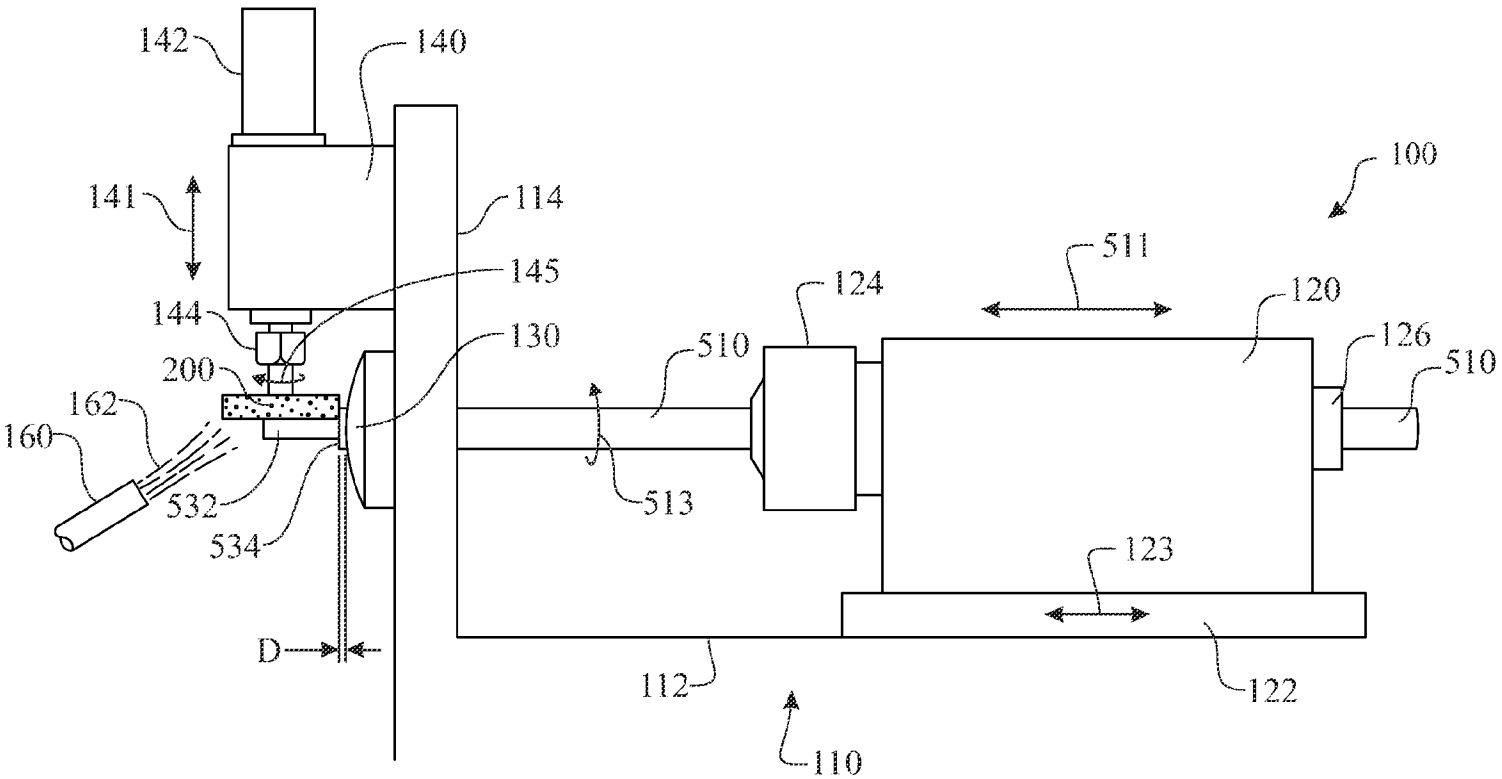
FIG. 9 presents a side elevation view of the Swiss style screw machine utilizing the plated superabrasive grinding wheel for fabricating a product in accordance with a second exemplary abrading process fabricating a ground arched surface onto the product.

A second exemplary embodiment is presented in FIG. 9, wherein the second exemplary fabrication process creates a ground arched surface 532. In addition to indexing the raw bar stock portion 510, the sliding head stock 120 rotates the raw bar stock portion 510 in accordance to a bar stock rotation 513. The plated superabrasive grinding wheel 200 rotates in accordance with a spindle collet chuck rotation 145. The abrasion is created by a motion of the cutting edge of the plated superabrasive grinding wheel 200 that is opposite of the motion of the working surface of the raw bar stock portion 510. The rotational motion of the raw bar stock portion 510 creates a rounded or arched surface referred to as a ground arched surface 532. A machined surface face 534 is created as a transition between the raw bar stock portion 510 and the ground arched surface 532. The ground arched surface 532 would generally have a circular cross sectional shape. It is understood that the raw bar stock portion 510 can be offset to create an oval cross sectional shape. If the raw bar stock portion 510 were square or rectangular, the ground arched surface 532 would result in cross sectional shape that is an oval, a square having radiused edges, and the like.

Figure 10:
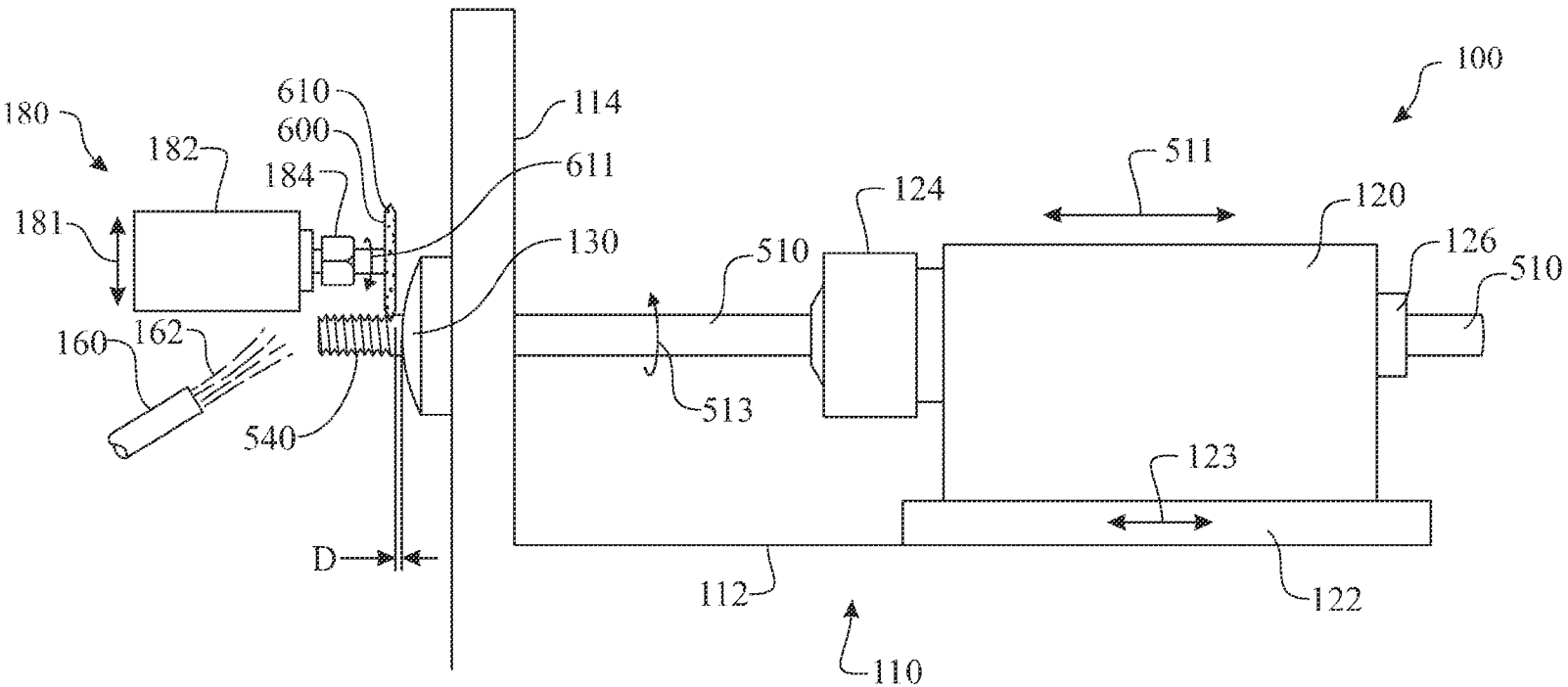
FIG. 10 presents a side elevation view of the Swiss style screw machine utilizing the plated superabrasive grinding wheel for fabricating a product in accordance with a third exemplary abrading process fabricating a ground thread section.

A third exemplary embodiment is presented in FIG. 10, wherein the third exemplary fabrication process creates a ground thread section 540. The third exemplary embodiment utilises a thread grinding superabrasive cutting wheel 600, which is shaped having a "V" shaped circumferential plated surface 610. The thread grinding superabrasive cutting wheel 600 is fabricated in the same manner as the plated superabrasive grinding wheel 200 previously described.

The thread grinding superabrasive cutting wheel 600 is mounted into a spindle collet chuck 184 of a tool spindle drive member 180. The tool spindle drive member 180 includes a tool spindle drive motor 182, which rotates the spindle collet chuck 184 along an axis that is parallel to a longitudinal axis of the raw bar stock portion 510. The tool spindle drive member 180 positions the thread grinding superabrasive cutting wheel 600 against the raw bar stock portion 510 in accordance with a tool spindle drive member motion 181. The thread grinding superabrasive cutting wheel 600 rotates in accordance with a thread grinding rotation 611, wherein the thread grinding rotation 611 is a rotation about an axis that is parallel to the longitudinal axis of the raw bar stock portion 510. Threads are shaped upon a working end of the 510 by the abrasion process, being illustrated as a ground thread section 540.

Figure 11:
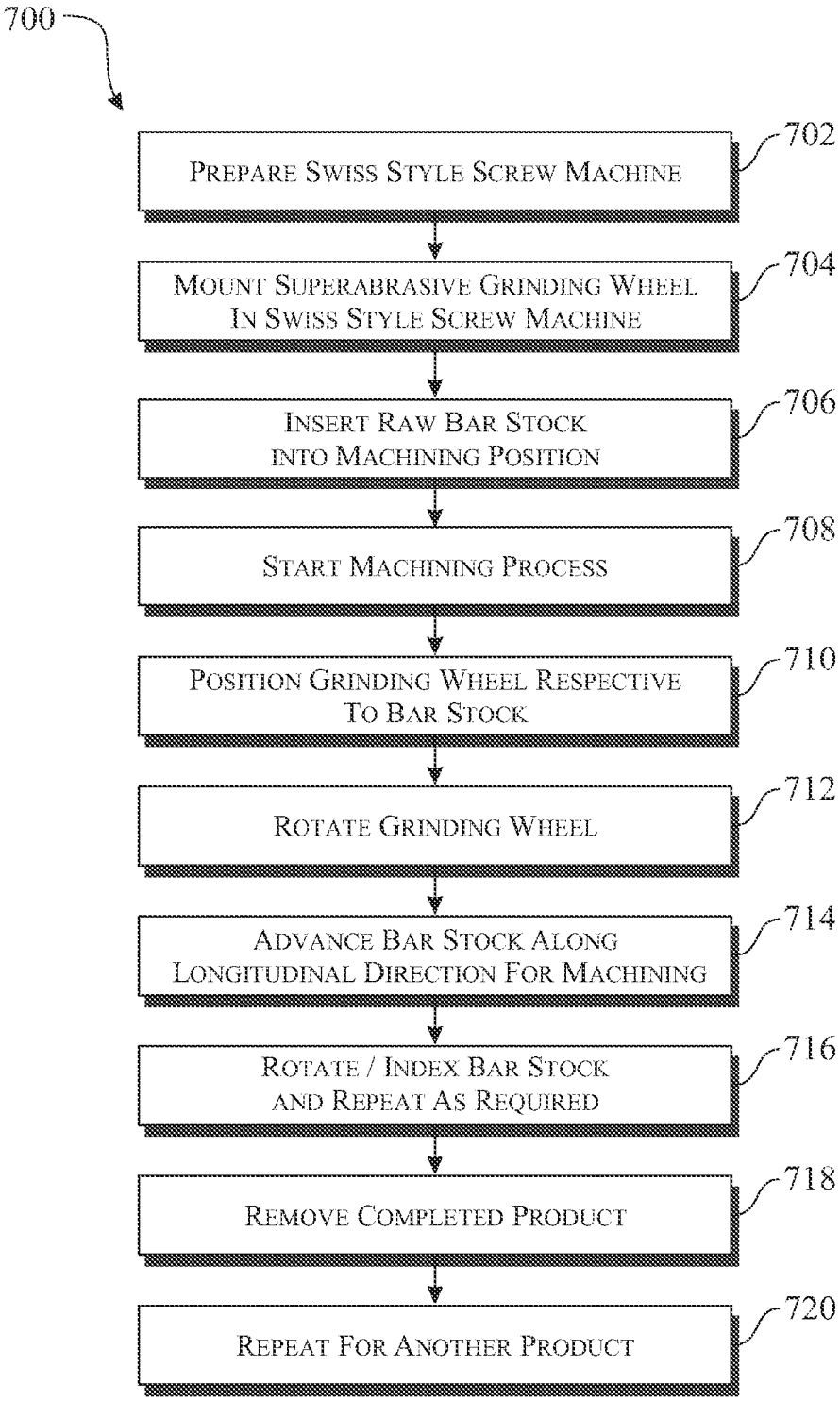
FIG. 11 presents an exemplary abrading product forming process.

The process is presented in an exemplary abrading product forming process 700 as illustrated in FIG. 11. The abrading product forming process 700 initiates with a Swiss style screw machine preparation step 702. The operator downloads a program respective to the desired product into the operational software of the Swiss style screw machine 100. The operator can optionally inspect the machine for readiness; including any wear, lubrication, loose components, and the like. The process continues with a step of mounting the plated superabrasive grinding wheel 200 into a spindle collet chuck 144 of the Swiss style screw machine 100 (step 704). The operator inserts the desired tools (including the plated superabrasive grinding wheel 200 and any other cutting tools) into the spindle collet chuck 144 and secures the tools in place. The vertical slide member 140 can include a single spindle collet chuck 144 or a series of spindle collet chucks 144. The operator inserts the raw bar stock portion 510 into a machining position (step 706). The operator slides the bar stock 500 into the bar stock rear guide 126, continuing through the bar stock clamping drive collet 124 and finally through the bar stock guide bushing 130. The operator ensures the position of the raw bar stock portion 510 within the sliding head stock 120 allows for sufficient travel and exposure of the working end of the raw bar stock portion 510. Once verified, the raw bar stock portion 510 is secured within the bar stock clamping drive collet 124. Once prepared, the abrading product forming process 700 transitions into a series of operation steps. The functional portion of the process initiates with a first operational step referred to as a start machining process step 708. Power is activated on the Swiss style screw machine 100 and the computer controlled operation is initiated. The Swiss style screw machine 100 positions the plated superabrasive grinding wheel 200 in the proper position respective to the working area of the raw bar stock portion 510 (step 710). The machine begins to spin the grinding wheel (step 712). The sliding head stock 120 moves in accordance with the head stock base motion 123, advancing the raw bar stock portion 510 in accordance with the bar stock motion 511 (step 714). The raw bar stock portion 510 is advanced along a longitudinal axis of the material. The raw bar stock portion 510 is supported by the bar stock guide bushing 130. As the raw bar stock portion 510 advances, the plated superabrasive 230 applied to the circumferential plated surface 232 of the plated superabrasive grinding wheel 200 removes a portion of the material of the raw bar stock portion 510 using an abrading process. The working surface of the raw bar stock portion 510 is supported by the bar stock guide bushing 130. Since the circumferential plated surface 232 of the plated superabrasive grinding wheel 200 is located very close to the working end of the bar stock guide bushing 130, the span D is very small. The short span reduces any potential bending of the raw bar stock portion 510, thus ensuring tight product dimensions. Upon completion of the planar machined surface 522, the plated superabrasive grinding wheel 200 and the working area of the raw bar stock portion 510 are separated. One such means would be to retract the raw bar stock portion 510 from the working area. Once separated, the raw bar stock portion 510 is rotated into a subsequent indexed position (step 716). The abrading process is repeated to form each subsequent planar machined surface 522 until the product is completed. Once the product is completed, the completed product is removed from the Swiss style screw machine 100 (step 718). This can be accomplished by parting the product section from the raw bar stock portion 510 or if the product includes the entire length of the raw bar stock portion 510, simply removed from the tool. When the raw bar stock portion 510 is depleted, the operator inserts another raw bar stock portion 510 into the machining position (repeating step 706) to begin fabricating a subsequent product (step 720). Upon completion of the final unit of the desired number of units, the operator removes the tools from the Swiss style screw machine 100, lubricates, and cleans up the machine.

The abrading product forming process 700 can be amended in accordance with the second exemplary embodiment, where the raw bar stock portion 510 is rotated by the sliding head stock 120 during the abrading process. This forms a ground arched surface 532 compared to the first exemplary process, which forms a series of planar machined surface 522.

The exemplary embodiments present products having a plurality of planar machined surfaces 522 indexed about the circumference of the bar stock 500 or a ground arched surface 532 about the circumference of the bar stock 500. It is understood that the finished product can be machined combining the surface styles having both a planar machined surface 522 and a ground arched surface 532. The exemplary embodiments present a plated superabrasive grinding wheel 200 being oriented parallel to or perpendicular to the longitudinal axis of the bar stock 500. It is understood that the plated superabrasive grinding wheel 200 can be oriented at any angle respective to the longitudinal axis of the bar stock 500 for fabricating unique shapes, such as a hex key having a ball shape on one end, which allows the tool to be used at an angle off-axis to the screw. The undercut clearance angle A would be sufficient to accommodate the respective angle being abraded during fabrication of the product.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A product fabrication method, the method comprising the steps:

obtaining a superabrasive grinding wheel, the superabrasive grinding wheel comprising:

a cylindrically shaped core, the core comprising a circumferential surface extending between an upper surface, a bottom surface and lower edge defined between the circumferential surface and the bottom surface, a shank extending axially from a central location of the core, a superabrasive plating applied to at least a lower portion of the circumferential surface of the core continuing around the lower edge of the core and along a circumferential edge of the bottom surface of the core;

mounting the shank of the superabrasive grinding wheel into a spindle collet chuck of a Swiss style screw machine;

positioning a section of raw bar stock into a machining position in the Swiss style screw machine;

positioning the superabrasive grinding wheel into position respective to the raw bar stock;

rotating the superabrasive grinding wheel about a concentric longitudinal axis of the shank;

supporting the raw bar stock using a bar stock guide bushing, wherein the guide bushing is located proximate the circumferential surface of the superabrasive grinding wheel;

advancing the raw bar stock passing in contact with the rotating plated superabrasive section of the core lower edge of the rotating superabrasive grinding wheel; and removing material from the raw bar stock using an abrading process created by contact between the rotating superabrasive grinding wheel against the raw bar stock.

2. A product fabrication method as recited in claim 1, the method further comprising the steps of:

retracting the bar stock, separating a working area of the bar stock from the rotating superabrasive grinding wheel;

rotating the bar stock to a subsequent index position; and repeating the step of advancing the raw bar stock passing in contact with the rotating superabrasive grinding wheel.

3. A product fabrication method as recited in claim 1, the method further comprising the step of:

rotating the bar stock during the step of removing material from the raw bar stock using the abrading process created by contact between the rotating superabrasive grinding wheel against the raw bar stock.

4. A product fabrication method as recited in claim 3, the method further comprising the steps of:

utilizing a superabrasive grinding wheel further comprising a "V" shaped circumferential plated surface; and rotating the superabrasive grinding wheel about an axis that is substantially parallel to a longitudinal axis of the bar stock to form threads.

5. A product fabrication method as recited in claim 3, the method further comprising the step of:

creating the abrasion by rotating the superabrasive grinding wheel in a direction where a motion of the circumferential plated surface is opposite of a motion of the rotating bar stock.

6. A product fabrication method as recited in claim 1, the method further comprising the step of:

applying a machining lubricant to and interface contact area created between the raw bar stock and the superabrasive grinding wheel.

7. A product fabrication method as recited in claim 1, the method further comprising the step of:

rotating the superabrasive grinding wheel about an axis that is substantially perpendicular to a longitudinal axis of the bar stock.

8. A product fabrication method as recited in claim 1, the method further comprising the step of:

increasing longevity of the cutting surface by applying a nickel plating surface over the superabrasive plating.

9. A product fabrication method, the method comprising the steps:

obtaining a superabrasive grinding wheel, the superabrasive grinding wheel comprising:

a cylindrically shaped core, the core comprising a circumferential surface extending between an upper surface, a bottom surface and lower edge defined between the circumferential surface and the bottom surface, wherein the bottoms surface is recessed and an outer edge of the bottom surface is lower than a central section of the bottom surface, a cylindrically shaped core, a shank extending axially from a central location of the core, a superabrasive plating applied to at least a lower portion of a circumferential surface of the core continuing around a lower edge of the core and along a circumferential edge of a bottom surface of the core;

mounting the shank of the superabrasive grinding wheel into a spindle collet chuck of a Swiss style screw machine;

positioning a section of raw bar stock into a machining position in the Swiss style screw machine;

positioning the superabrasive grinding wheel into position respective to the raw bar stock;

rotating the superabrasive grinding wheel about a concentric longitudinal axis of the shank;

supporting the raw bar stock using a bar stock guide bushing, wherein the guide bushing is located proximate the circumferential surface of the superabrasive grinding wheel;

advancing the raw bar stock passing in contact with the rotating plated superabrasive section of the core lower edge of the rotating superabrasive grinding wheel; and removing material from the raw bar stock using an abrading process created by contact between the superabrasive plating applied to the circumferential surface and the lower edge of the rotating superabrasive grinding wheel against the raw bar stock, where the recessed lower surface provides a gap therebetween.

10. A product fabrication method as recited in claim 9, the method further comprising the steps of:

retracting the bar stock, separating a working area of the bar stock from the rotating superabrasive grinding wheel;

rotating the bar stock to a subsequent index position; and repeating the step of advancing the raw bar stock passing in contact with the rotating superabrasive grinding wheel.

11. A product fabrication method as recited in claim 9, the method further comprising the step of:

rotating the bar stock during the step of removing material from the raw bar stock using the abrading process created by contact between the rotating superabrasive grinding wheel against the raw bar stock.

12. A product fabrication method as recited in claim 11, the method further comprising the step of:

creating the abrasion by rotating the superabrasive grinding wheel in a direction where a motion of the circumferential plated surface is opposite of a motion of the rotating bar stock.

13. A product fabrication method as recited in claim 9, the method further comprising the step of:

applying a machining lubricant to and interface contact area created between the raw bar stock and the superabrasive grinding wheel.

14. A product fabrication method as recited in claim 9, the method further comprising the step of:

rotating the superabrasive grinding wheel about an axis that is substantially perpendicular to a longitudinal axis of the bar stock.

15. A product fabrication method as recited in claim 9, the method further comprising the step of:

increasing longevity of the cutting surface by applying a nickel plating surface over the superabrasive plating.

16. A product fabrication method, the method comprising the steps:

obtaining a superabrasive grinding wheel, the superabrasive grinding wheel comprising:

a cylindrically shaped core, the core comprising a circumferential surface extending between an upper surface, a bottom surface and lower edge defined between the circumferential surface and the bottom surface, a shank extending axially from a central location of the core, a superabrasive plating applied to at least a lower portion of the circumferential surface of the core continuing around the lower edge of the core and along a circumferential edge of the bottom surface of the core;

mounting the shank of the superabrasive grinding wheel into a spindle collet chuck of a Swiss style screw machine;

positioning a section of raw bar stock into a machining position in the Swiss style screw machine;

positioning the superabrasive grinding wheel into position respective to the raw bar stock;

rotating the superabrasive grinding wheel about a concentric longitudinal axis of the shank;

supporting the raw bar stock using a bar stock guide bushing, wherein the guide bushing is located proximate the circumferential surface of the superabrasive grinding wheel;

advancing the raw bar stock passing in contact with the rotating plated superabrasive section of the core lower edge of the rotating superabrasive grinding wheel;

removing material from the raw bar stock using an abrading process created by contact between the rotating superabrasive grinding wheel against the raw bar stock; and applying a machining lubricant to and interface contact area created between the raw bar stock and the superabrasive grinding wheel during abrading process.

17. A product fabrication method as recited in claim 16, the method further comprising the steps of:

retracting the bar stock, separating a working area of the bar stock from the rotating superabrasive grinding wheel;

rotating the bar stock to a subsequent index position; and repeating the step of advancing the raw bar stock passing in contact with the rotating superabrasive grinding wheel.

18. A product fabrication method as recited in claim 16, the method further comprising the step of:

rotating the bar stock during the step of removing material from the raw bar stock using the abrading process created by contact between the rotating superabrasive grinding wheel against the raw bar stock.

19. A product fabrication method as recited in claim 18, the method further comprising the steps of:

utilizing a superabrasive grinding wheel further comprising a "V" shaped circumferential plated surface; and rotating the superabrasive grinding wheel about an axis that is substantially parallel to a longitudinal axis of the bar stock to form threads.

20. A product fabrication method as recited in claim 18, the method further comprising the step of:

creating the abrasion by rotating the superabrasive grinding wheel in a direction where a motion of the circumferential plated surface is opposite of a motion of the rotating bar stock.

21. A product fabrication method as recited in claim 16, the method further comprising the step of:

rotating the superabrasive grinding wheel about an axis that is substantially perpendicular to a longitudinal axis of the bar stock.

22. A product fabrication method as recited in claim 16, the method further comprising the step of:

increasing longevity of the cutting surface by applying a nickel plating surface over the superabrasive plating.

* * * * *